US008941320B2

(12) United States Patent
Choi et al.

(10) Patent No.: US 8,941,320 B2
(45) Date of Patent: Jan. 27, 2015

(54) METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

(71) Applicant: Samsung Display Co., Ltd., Yongin, Gyeonggi-Do (KR)

(72) Inventors: Min-Soo Choi, Asan-si (KR); Won-Sik Oh, Seoul (KR); Eun-Chul Shin, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 21 days.

(21) Appl. No.: 13/844,592

(22) Filed: Mar. 15, 2013

(65) Prior Publication Data

US 2013/0313985 A1 Nov. 28, 2013

(30) Foreign Application Priority Data

May 22, 2012 (KR) ..... 10-2012-0054416

(51) Int. Cl.

| | |
|---|---|
| ***G05F 1/00*** | (2006.01) |
| ***G05F 1/40*** | (2006.01) |
| ***H05B 39/00*** | (2006.01) |
| ***H05B 41/36*** | (2006.01) |
| ***H05B 33/08*** | (2006.01) |

(52) U.S. Cl.

CPC ..... *H05B 33/0815* (2013.01); *H05B 33/0854* (2013.01)

USPC ..... 315/291; 315/308; 315/247; 323/280; 323/304

(58) Field of Classification Search

CPC ..... H05B 41/16

USPC ..... 315/360, 247, 185, 291, 307, 312; 345/208

See application file for complete search history.

(56) References Cited

U.S. PATENT DOCUMENTS

| | | | | |
|---|---|---|---|---|
| 7,847,783 | B2 | 12/2010 | Liu et al. | |
| 2010/0156323 | A1 * | 6/2010 | Jan et al. | 315/307 |
| 2010/0308733 | A1 * | 12/2010 | Shao | 315/119 |
| 2011/0254468 | A1 * | 10/2011 | Chen et al. | 315/307 |
| 2012/0139434 | A1 * | 6/2012 | Hsu et al. | 315/210 |
| 2012/0153866 | A1 * | 6/2012 | Liu | 315/294 |
| 2012/0181939 | A1 * | 7/2012 | Szczeszynski et al. | 315/186 |
| 2012/0274228 | A1 * | 11/2012 | Szczeszynski | 315/224 |
| 2013/0140990 | A1 * | 6/2013 | Campos et al. | 315/120 |
| 2013/0169172 | A1 * | 7/2013 | Kesterson et al. | 315/186 |
| 2014/0055045 | A1 * | 2/2014 | Raval et al. | 315/186 |

FOREIGN PATENT DOCUMENTS

| | | |
|---|---|---|
| JP | 2008-130523 | 6/2008 |
| KR | 10-0727354 | 6/2007 |

* cited by examiner

*Primary Examiner* — Douglas W Owens
*Assistant Examiner* — Wei Chan
(74) *Attorney, Agent, or Firm* — Innovation Counsel LLP

(57) ABSTRACT

A method of driving a light source includes outputting a variable driving voltage to a light source part, sensing a first voltage based on the driving voltage and developed at a first end of the light source part, sensing a second voltage developed at a second end of the light source part due to current passing through the light source part and adjusting the driving voltage while using the first and second voltages so that power consumption by the light source part is substantially constant irrespective of temperature of the light source part and/or irrespective of a duty cycle ration being used to drive the light source part. Thus, a luminance of the light source part may be maintained at substantially uniform levels.

14 Claims, 10 Drawing Sheets

METHOD OF DRIVING A LIGHT SOURCE, LIGHT SOURCE APPARATUS FOR PERFORMING THE METHOD AND DISPLAY APPARATUS HAVING THE LIGHT SOURCE APPARATUS

CROSS-REFERENCE TO RELATED APPLICATION

This application claims priority to Korean Patent Application No. 10-2012-0054416, filed on May 22, 2012, and all the benefits accruing therefrom under 35 U.S.C. §119, where the contents of said application in their entirety are herein incorporated by reference.

BACKGROUND

1. Field of Disclosure

The present disclosure of invention relates to a method of driving a light source, a light source apparatus for performing the method and a display apparatus having the light source apparatus. More particularly, the present disclosure relates to a method of driving a light source while maintaining a respective luminance and a respective power consumption of the light source respectively in substantially uniform levels.

2. Description of Related Technology

Generally, it is desirable to provide a liquid crystal display apparatus with a relatively small thickness, a relatively light weight and a relatively low power consumption so that the liquid crystal display apparatus can be broadly used for mobile and other applications such as for a monitor, a laptop computer, a cellular phone, a television and so on. The typical liquid crystal display (LCD) apparatus includes a liquid crystal display panel configured for displaying an image using a light transmittance characteristic of a liquid crystal and using a light source apparatus providing a light to the liquid crystal display panel. For example, the light source apparatus may be a backlighting assembly that provides light to a back side of the LCD panel.

The light source apparatus typically includes a plurality of light sources generating a light required to display an image on the liquid crystal display panel. For example, the light sources may include at least one of a cold cathode fluorescent lamp ("CCFL"), an external electrode fluorescent lamp ("EEFL"), a flat fluorescent lamp ("FFL"), and one or more light emitting diodes ("LEDs").

Recently, LED's having a relatively low power consumption and those being eco-friendly has been developed. The typical light source apparatus therefore includes a string of LEDs connected for example in series with each other, and a LED driver configured for driving the LED string.

A conventional light source apparatus uses a constant current driving method in which a constant current is caused to flows through the LED string to thereby energize the LED string. However, the current-voltage characteristic of LEDs often varies according to ambient temperature and/or other factors. Thus, a luminance and a power consumption of the LED may vary as local temperature varies while being driven by the constant current driving method. Accordingly, although the LED string current might be kept constant, LED string voltage and power consumption are likely to undesirably vary as a function of local temperature.

In addition to the temperature variation problem, when an LED is just turned on, the temperature of the LED is relatively low so that the luminance of the LED is relatively high. In contrast, as the duration of being turned-on increases for the LED, the local temperature of the LED tends to increase so that the luminance of the LED changes (e.g., decreases). Accordingly, a display quality of a display apparatus may decrease due to changes in ambient temperature and/or due to changes in drive duration.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

BRIEF SUMMARY

Exemplary embodiments in accordance with the present disclosure of invention are provided here including a method of driving a light source in such a way so as to maintain a luminance and a power consumption of the light source part at substantially uniform levels irrespective of a temperature of the light source part and/or irrespective of a duty cycle ratio being used to drive the light source part.

Additionally, the present disclosure provides a light source apparatus for performing the method of driving the light source part.

Additionally, the present disclosure also provides a display apparatus having the light source apparatus.

In an exemplary method of driving a light source part in accordance with the present disclosure, a variable driving voltage is applied to the light source part, a first voltage is sensed at a first terminal of the light source part and is based on the driving voltage applied to the light source part, a second voltage is sensed at an opposed second terminal end of the light source part and is based on a driving current passing through the light source part. The combination of the sensed first and second voltages are used to develop a signal representing power consumption of the light source part and the latter is used in a feedback loop for adjusting the driving voltage applied to the light source part.

In an exemplary embodiment, the light source part may include a plurality of light emitting diodes connected to each other in series.

In an exemplary embodiment, the light source part may include a plurality of light emitting diode strings connected to each other in parallel. Each of the light emitting diode strings may include a plurality of light emitting diodes connected to each other in series.

In an exemplary embodiment, the first voltage may be a divided voltage of the driving voltage derived by a voltage divider network having a first resistor and a second resistor.

In an exemplary embodiment, the adjusting of the driving voltage may include generating a third voltage based on the first voltage and a supplied first reference voltage, generating a fourth voltage based on the second voltage and the third voltage and comparing the fourth voltage to a time-varying and supplied comparing signal so as to output a corresponding feedback signal.

In an exemplary embodiment, the adjusting the driving voltage may include generating a multiplied voltage by multiplying the first voltage and the second voltage, generating a fourth voltage based on the multiplied voltage and a reference voltage and comparing the fourth voltage to a comparing signal to output a feedback signal.

In an exemplary embodiment, the generating of the multiplied voltage may include multiplying the first voltage as an analog type and the second voltage as an analog type.

In an exemplary embodiment, the generating of the multiplied voltage may include converting the first voltage to a digital type, converting the second voltage to the digital type, and using a data processing unit to multiply the converted first and second voltages.

In an exemplary embodiment of a light source apparatus according to the present disclosure, the light source apparatus includes a light source part, a voltage generating part and a feedback part. The light source part emits a light. The voltage generating part generates a driving voltage to drive the light source part. The feedback part adjusts the driving voltage using a first voltage sensed from a first end of the light source part and a second voltage sensed from a second end of the light source par. The first voltage is based on the driving voltage and the second voltage is based on a driving current passing through the light source part.

In an exemplary embodiment, the light source part may include a plurality of light emitting diodes connected to each other in series.

In an exemplary embodiment, the light source part may include a plurality of light emitting diode strings connected to each other in parallel. Each of the light emitting diode strings may include a plurality of light emitting diodes connected to each other in series.

In an exemplary embodiment, the voltage generating part may include a driving circuit, an inductor, a diode, a gate resistor, a capacitor and a switching element. The driving circuit may receive a feedback signal from the feedback part and may be connected to a first end of the gate resistor. A gate electrode of the switching element may be connected to a second end of the gate resistor, a source electrode of the switching element may be connected to a ground, and a drain electrode of the switching element may be connected to a second end of the inductor and an anode electrode of the diode. A power voltage may be applied to a first end of the inductor. A cathode electrode of the diode may be connected to a first end of the capacitor. A second end of the capacitor may be connected to the ground.

In an exemplary embodiment, the first voltage may be a divided voltage of the driving voltage by a first resistor and a second resistor.

In an exemplary embodiment, the feedback part may include a reference voltage compensating circuit generating a third voltage based on the first voltage and a first reference voltage, a first differential amplifier generating a fourth voltage based on the second voltage and the third voltage and a comparator comparing the fourth voltage to a reference voltage to output a feedback signal.

In an exemplary embodiment, the reference voltage compensating circuit may include a second differential amplifier, a third resistor and a fourth resistor. The first reference voltage may be applied to a non-inverting input node of the second differential amplifier. An inverting input node of the second differential amplifier may be connected to a first end of the third resistor and a first end of the fourth resistor. An output node of the second differential amplifier may be connected to a second end of the third resistor. The first voltage may be applied to a second end of the fourth resistor.

In an exemplary embodiment, the feedback part may include a signal multiplying part generating a multiplied voltage by multiplying the first voltage and the second voltage, a differential amplifier generating a fourth voltage based on the multiplied voltage and a reference voltage and a comparator comparing the fourth voltage to a comparing signal to output a feedback signal.

In an exemplary embodiment, the signal multiplying part may include a first buffer, a second buffer, a third buffer and a multiplier. The first voltage may be applied to the first buffer. The second voltage may be applied to the second buffer. The multiplier may multiply the first voltage and the second voltage to generate the multiplied voltage and may output the multiplied voltage to the third buffer.

In an exemplary embodiment, the multiplier may include a first differential voltage to current converter receiving the first voltage, a second differential voltage to current converter receiving the second voltage, a differential to single ended converter outputting the multiplied voltage, first and second transistors which are connected to the first differential voltage to current converter, and third, fourth, fifth and sixth transistors which are connected to the second differential voltage to current converter and the differential to single ended converter.

In an exemplary embodiment, the signal multiplying part may include a first analog to digital converter receiving the first voltage and converting the first voltage to a digital type, a second analog to digital converter receiving the second voltage and converting the second voltage to the digital type, a micro control unit (or other data processing unit) generating a multiplied voltage by multiplying the first voltage having the digital type and the second voltage having the digital type and optionally, a digital to analog converter receiving the multiplied voltage and converting the multiplied voltage to an analog type.

In an exemplary embodiment of a display apparatus according to the present invention, the display apparatus includes a display panel and a light source apparatus. The display panel displays an image. The light source apparatus provides a light to the display panel. The light source apparatus includes a light source part, a voltage generating part and a feedback part. The light source part emits a light. The voltage generating part generates a driving voltage to drive the light source part. The feedback part adjusts the driving voltage using a first voltage outputted to a first end of the light source part and a second voltage sensed at a second end of the light source par. The first voltage is based on the driving voltage.

According to the method of driving the light source, the light source apparatus and the display apparatus including the light source apparatus, the driving voltage applied to the light source part is adjusted using the voltage control parameter and the current control parameter of the light source part so that a luminance and a power consumption of the light source part may be maintained in a substantially uniform levels regardless of a local temperature condition or a driving level of the light source. Thus, a display quality of the display apparatus may be improved.

BRIEF DESCRIPTION OF THE DRAWINGS

The above and other features and advantages of the present disclosure of invention will become more apparent by describing in detail, exemplary embodiments thereof with reference to the accompanying drawings, in which.

DETAILED DESCRIPTION

Hereinafter, exemplary embodiments of the present disclosure of invention will be described in further detail with reference to the accompanying drawings.

Figure 1:
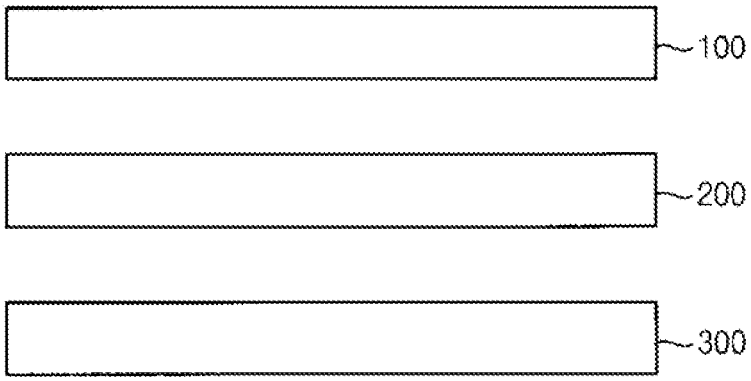
FIG. 1 is a block diagram illustrating a display apparatus according to an exemplary first embodiment of the present disclosure.

FIG. 1 is a block diagram illustrating a display apparatus according to a first exemplary embodiment.

Referring to FIG. 1, the display apparatus includes a display panel 100, a light adjusting part 200 and a light source apparatus 300.

The display panel 100 is configured to display an image based on received, image defining signals. In one embodiment, the display panel 100 includes a first substrate, a second substrate and a liquid crystal layer, a gate lines driver and a data lines driver.

The first substrate may be a thin film transistor ("TFT") array substrate including a plurality of TFTs. The second substrate faces the first substrate. The second substrate may be a color filter substrate including a color filter. The liquid crystal layer is disposed between the first substrate and the second substrate.

The gate lines driver and the data lines driver (not shown) are connected to the first substrate to output respective gate and data lines driving signals to the first substrate. The gate and data lines drivers may include a flexible printed circuit board ("FPC"), a driving chip mounted on the FPC and a printed circuit board ("PCB") connected to a first end of the FPC.

The light adjusting part 200 may include a protecting sheet, a prism sheet and a diffusion sheet.

The protecting sheet protects the prism sheet from scratches. The prism sheet may include a plurality of prisms disposed with a uniform gap on an upper surface. Each of the prisms may have a triangular shape in a cross-sectional view. The prism sheet condenses a light diffused by the diffusion sheet in a direction substantially perpendicular to the display panel 100. The diffusion sheet diffuses a light provided from a light source part so that luminance uniformity may be improved.

The light source apparatus 300 includes a light source part and a light source driver. The light source part includes a plurality of light sources. For example, the light source part includes a plurality of light emitting diodes ("LEDs").

The light source driver is connected to the light source part. The light source driver provides a driving voltage and/or a driving current to the light source part. The light source driver may be disposed outside of a light sources receiving container. For example, the light source driver may be disposed facing a rear surface of a bottom plate of the receiving container.

A structure and an operation of the light source apparatus 300 are explained in detail referring to FIGS. 2 to 8.

Figure 2:
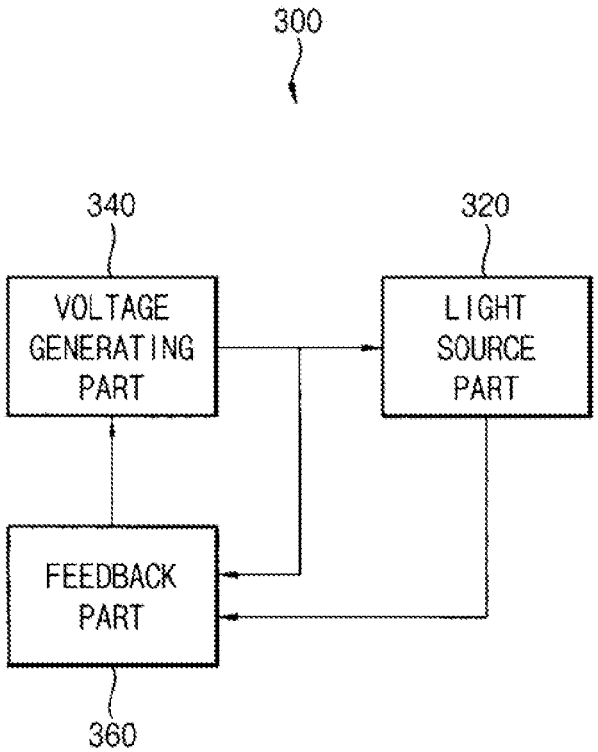
FIG. 2 is a block diagram illustrating a schematic of the light source apparatus of FIG. 1.
Figure 3:
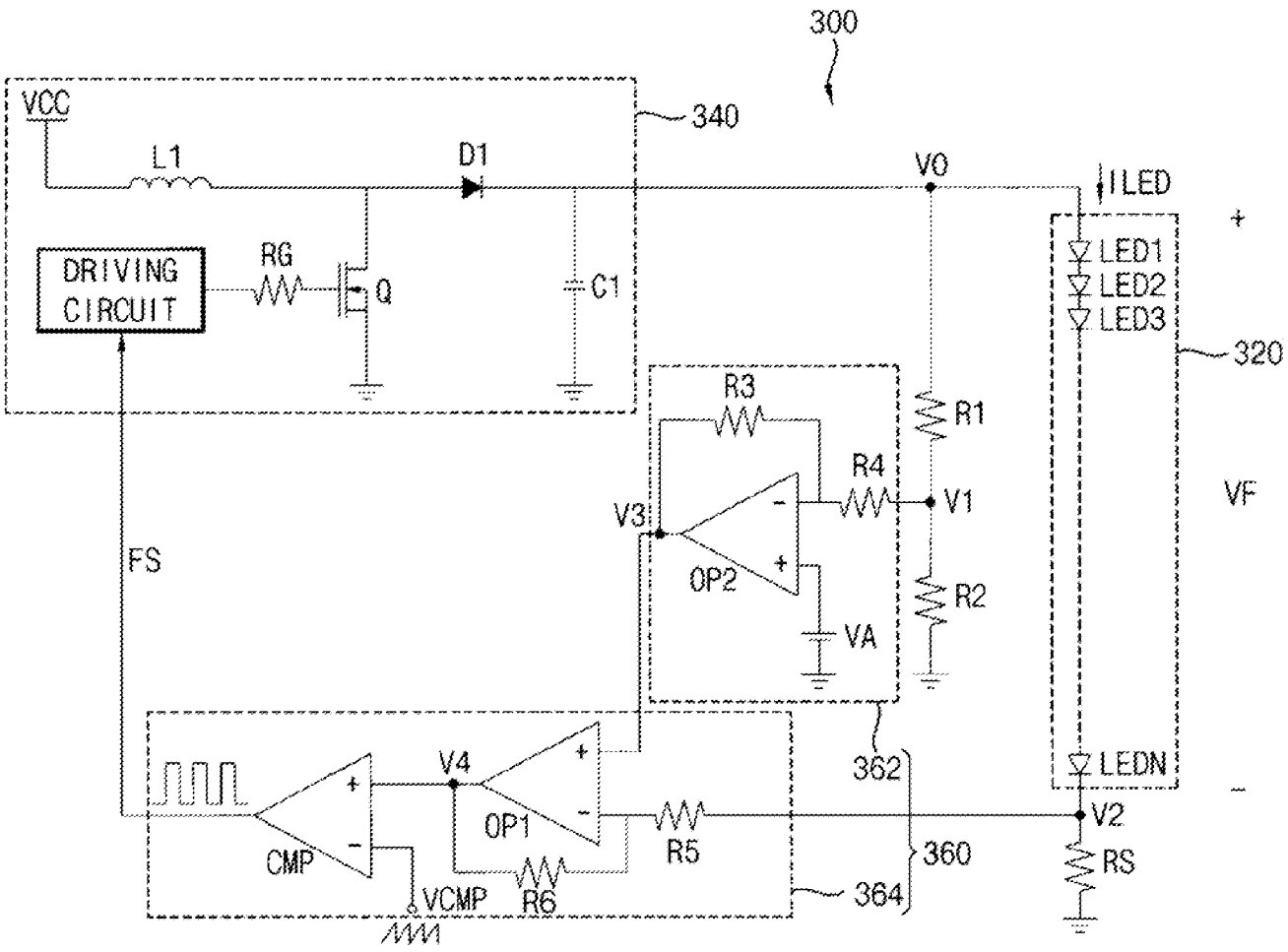
FIG. 3 is a circuit diagram illustrating the light source apparatus of FIG. 1.

FIG. 2 is a block diagram illustrating a light source apparatus 300 of FIG. 1. FIG. 3 is a circuit diagram illustrating the light source apparatus 300 of FIG. 1.

Referring to FIGS. 1 to 3, the light source apparatus 300 includes a light source part 320, a voltage generating part 340 and a feedback part 360.

The light source part 320 is configured to emit a light. The light source part 320 provides the light to the display panel 100. The light source part 320 includes a plurality of LEDs connected to each other in series. The light source part 320 includes first to N-th LEDs LED1 to LEDN connected as a first among plural and similar strings.

In the present exemplary embodiment, the light source part 320 may include just a single LED string. The light source apparatus 300 may be an edge type lighting apparatus that outputs its light to a side edge of a light guiding plate (LGP—not shown). The light source part 320 may be disposed corresponding to a single side of the display panel 100. For example, the light source part 320 may be disposed corresponding to a shorter side of the display panel 100. Alternatively, the light source part 320 may be disposed corresponding to a longer side of the display panel 100. The light source apparatus 300 may further include a light guide plate (LGP) configured for guiding the light generated from the light source part 320 to the display panel 100. The light guide plate may include a rectangular parallelepiped shape. The light guide plate may include a wedge shape in a cross-sectional view.

The voltage generating part 340 generates a driving voltage VO (measured relative to ground) to drive the light source part 320. The driving voltage VO is an output of the voltage generating part 340 so that the driving voltage VO may be referred to as an output voltage VO. For example, the voltage generating part 340 may be a switched DC (direct-current) to DC converter. Alternatively, the voltage generating part 340 may be a linear down converter.

The switched DC/DC version of the voltage generating part 340 includes a driving circuit, an inductor L1, a diode D1, a gate resistor RG, a capacitor C1 and a switching element Q.

The driving circuit receives a feedback signal FS from a feedback part 360. The driving circuit is connected to a first end of the gate resistor RG. The driving circuit adjusts a turn-on duration of the repeatedly switched on and off switching element Q based on the feedback signal FS to thereby adjust a charging time of the inductor L1, and ultimately thereby adjust a level of the driving voltage VO.

A gate electrode of the switching element Q is connected to a second end of the gate resistor RG. A source electrode of the switching element Q is connected to a ground. A drain electrode of the switching element Q is connected to a second end of the inductor L1 and an anode electrode of the diode D1.

A predetermined power voltage level VCC is applied to a first end of the inductor L1. A cathode of the diode D1 is connected to a first end of the capacitor C1. A second end of the capacitor C1 is connected to the ground.

The feedback part 360 generates the feedback signal FS for adjusting the driving voltage VO. The feedback part 360 outputs the feedback signal FS to the voltage generating part 340.

The feedback part 360 generates the feedback signal FS using a first voltage V1, which is based on (e.g., a linear function of) the driving voltage VO outputted to a first end of the light source part 320, and based on a second voltage V2 sensed at a second end of the light source part 320 where a current sensing element (e.g., RS) is interposed between the node where V2 is sensed and ground.

The first used voltage V1 is one based on (e.g., a function of) the driving voltage VO applied to the light source part 320 so that the first voltage V1 may be referred to as a voltage control parameter. The second used voltage V2 is one proportional to a LED current $I_{LED}$ flowing through the light source part 320 so that the second voltage V2 may be referred to as a current control parameter. The feedback part 360 generates the feedback signal FS while using both of the voltage control parameter (V1) and the current control parameter (V2). More specifically, since the combination of the voltage control parameter (V1) and the current control parameter (V2) corresponds to the amount of power being consumed by the monitored light source part 320 (e.g., LEDs string), the feedback part 360 may control the light source part 320 such that the latter is driven in a substantially constant power mode.

The difference between VO and V2 defines a forward drop voltage, VF where the latter may be used as a more precise indicator of the voltage control parameter of the light source part 320. However, in a more practical sense and for relatively low values of sensing resistance Rs, the driving voltage VO by itself is substantially proportional to the forward voltage VF, and has a level substantially the same as a level of the forward voltage VF and is easier to sense as compared with sensing the forward voltage VF so that the driving voltage VO is used herein as a proxy for the voltage control parameter of the light source part 320 in the present exemplary embodiment.

The first voltage V1 is a linearly divided version of the driving voltage VO and in one embodiment, the linear voltage division is carried out by a divider network having a first resistor R1 and a second resistor R2. A first end of the first resistor R1 is connected to an output node of the voltage generating part 340. A second end of the first resistor R1 is connected to a first end of the second resistor R2. A second end of the second resistor R2 is connected to the ground. The first voltage V1 is a voltage sensed at a common node disposed between the first resistor R1 and the second resistor R2.

In the present exemplary embodiment, the feedback part 360 includes a reference voltage compensating circuit 362 and a feedback signal generating part 364. The feedback signal generating part 364 includes a first differential amplifier OP1 and a comparator CMP.

The reference voltage compensating circuit 362 receives the first voltage V1 and a predetermined first reference voltage VA. The reference voltage compensating circuit 362 generates a third voltage V3 based on a difference between the first voltage V1 and the first reference voltage VA. The third voltage V3 serves as a reference voltage for the differential amplifier OP1 so that the third voltage V3 may be referred to as a second reference voltage V3. A structure and an operation of the feedback signal generating part 364 are now further explained in more detail.

The first differential amplifier OP1 receives the second voltage V2 and the third voltage V3. The first differential amplifier OP1 generates a fourth voltage V4 based on the difference between the second voltage V2 and the third voltage V3. The third voltage V3 is applied to a non-inverting input node of the first differential amplifier OP1. The second voltage V2 is applied to an inverting input node of the first differential amplifier OP1. The fourth voltage V4 is outputted at an output node of the first differential amplifier OP1. The fourth voltage V4 is proportional to a difference between the third voltage V3 and the second voltage V2. A fifth resistor R5 is disposed between the inverting input node (the one shown receiving V2) of the first differential amplifier OP1 and the second end of the light source part 320. In addition, a sixth resistor R6 is disposed between the inverting input node of the first differential amplifier OP1 and the output node of the first differential amplifier OP1.

The comparator CMP receives at one input thereof, the fourth voltage V4 and at a second input thereof, a time varying (e.g., sawtooth waveform shaped) comparing signal VCMP. The comparator CMP compares the fourth voltage V4 to the comparing signal VCMP and responsively outputs the feedback signal FS. The fourth voltage V4 is applied to a non-inverting input node of the comparator CMP. The comparing signal VCMP is applied to an inverting input node of the comparator CMP. The feedback signal FS is outputted at an output node of the comparator CMP. The comparing signal VCMP may be a triangular or sawtooth wave signal. The feedback signal FS may be a digital signal (e.g., a square wave signal).

The feedback signal FS has a high level when the fourth voltage V4 is greater than the comparing signal VCMP. The feedback signal FS has a low level when the fourth voltage V4 is less than the comparing signal VCMP. As the fourth voltage V4 increases, a duty ratio of the feedback signal FS increases. As the fourth voltage V4 decreases, the duty ratio of the feedback signal FS decreases.

The reference voltage compensating circuit 362 includes a second differential amplifier OP2, a third resistor R3 and a fourth resistor R4. The first reference voltage VA is applied to a non-inverting input node of the second differential amplifier OP2. An inverting input node of the second differential amplifier OP2 is connected to a first end of the third resistor R3 and a first end of the fourth resistor R4. An output node of the second differential amplifier OP2 is connected to a second end of the third resistor R3. The first voltage V1 is applied to a second end of the fourth resistor R4.

In the illustrated example, the third voltage V3 is determined as following linear Equation 1.

$$V3 = -\frac{R3}{R4}V1 + \left(1 + \frac{R3}{R4}\right)VA \qquad \text{[Equation 1]}$$

When the driving voltage VO increases, the first voltage V1 increases. When the first voltage V1 increases, the third voltage V3 which is the reference voltage of the first differential amplifier OP1 decreases.

In contrast, when the driving voltage VO decreases, the first voltage V1 decreases. When the first voltage V1 decreases, the third voltage V3 which is the reference voltage of the first differential amplifier OP1 increases.

The third voltage V3 thus linearly varies according to the first voltage V1. A range of the third voltage V3 may be properly adjusted according to a ratio between a resistance of the third resistor R3 and a resistance of the fourth resistor R4 and according to the setting of the first reference voltage VA.

More generally, the above Equation 1 is an example of a fixed function of $V_O$ which may be expressed as $f_{FIXED}(V_O)$. The negative feedback loop that includes OP1 operates to reduce error between V2 (which corresponds to $I_{LEDs}$) and $f_{FIXED}(V_O)$. This may be expressed as: $I_{LEDs}=f_{FIXED}(V_O)+$ error. Power may be approximated as $P=V_O*I_{LEDs}$ and, by substitution as $P=V_O*(f_{FIXED}(V_O)+\text{error})$. Thus, roughly speaking, power P is caused to be a function of $f_{FIXED}(\,)$ when the feedback system settles into steady state. The reason for wanting to keep power relatively steady is now explained.

Figure 4:
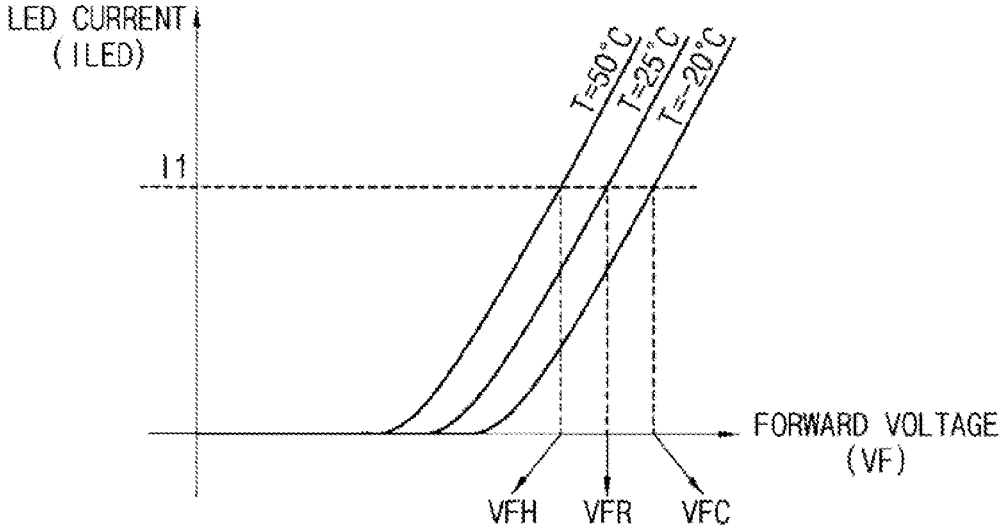
FIG. 4 is a graph illustrating a current-voltage characteristic of a light source part of FIG. 2 according to change in local temperature.
Figure 5:
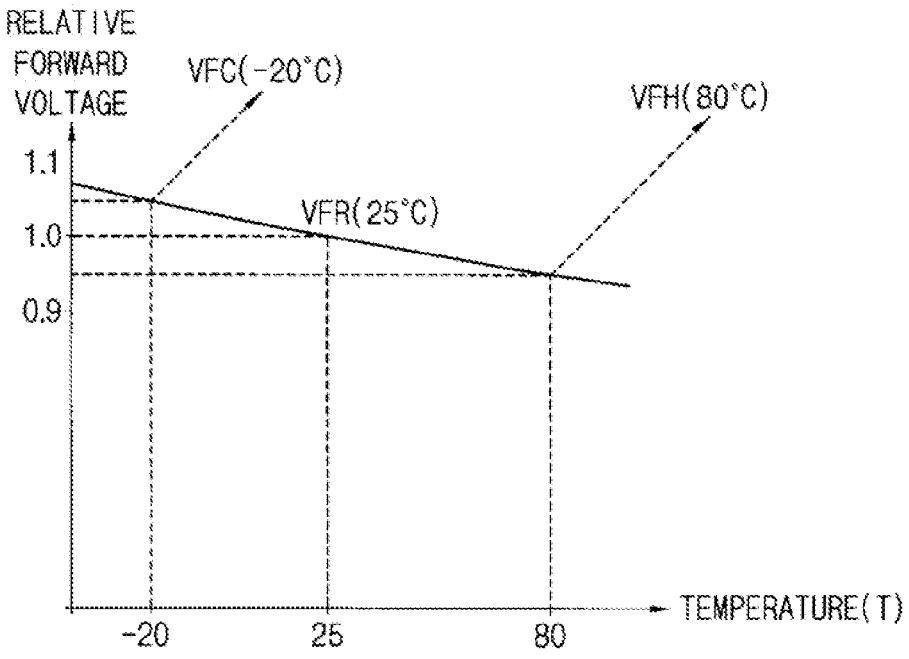
FIG. 5 is a graph illustrating a relative forward voltage of the light source part of FIG. 2 according to temperature.
Figure 6:
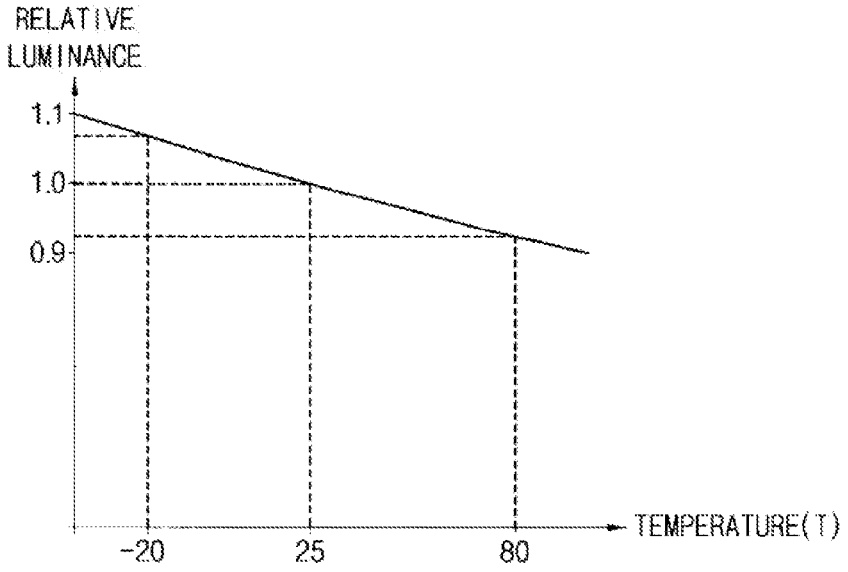
FIG. 6 is a graph illustrating a relative luminance of the light source part of FIG. 2 according to temperature.

FIG. 4 is a graph illustrating a current versus voltage characteristic of the light source part 320 of FIG. 2 according to a local temperature T of the LEDs. FIG. 5 is a graph illustrating a relative forward voltage drop, VF of the light source part 320 of FIG. 2 according to the temperature T. FIG. 6 is a graph illustrating a relative luminance of the light source part 320 of FIG. 2 according to the temperature T. The temperature T of the light source part 320 may be a function of the local ambient temperature and of the power (P) consumed by the light source part 320 (which consumed power dissipates as heat energy).

Referring to FIG. 4, the current-voltage characteristic of the LED of the light source part 320 may vary according to the local temperature T as shown. When the LED current ILED flowing through the LED is fixed at I1 and the ambient temperature T is a room temperature (25° C.), the forward voltage VF of the light source part 320 is a first forward voltage VFR. When the LED current ILED is fixed at I1 and the ambient temperature T is 50° C., which is higher than 25° C., the forward voltage VF of the light source part 320 is a second forward voltage VFH, which is less than the first forward voltage VFR. When the LED current ILED is I1 and the ambient temperature T is −20° C., which is lower than +25° C., the forward voltage VF of the light source part 320 is a third forward voltage VFC, which is greater than the first forward voltage VFR.

Referring to FIG. 5, when the first forward voltage VFR is set to 1.0 in the ambient temperature T of the room temperature (25° C.), the second forward voltage VFH is about 0.95 in the ambient temperature T of 50° C. and the third forward voltage VFC is about 1.05 in the ambient temperature T of −20° C.

Referring to FIG. 6, when a first luminance of the light source part 320 is set to 1.0 in the ambient temperature T of the room temperature (25° C.), a second luminance of the light source part 320 is about 0.92 in the ambient temperature T of 50° C., which is less than the first luminance, and a third luminance of the light source part 320 is about 1.08 in the ambient temperature T of −20° C., which is greater than the first luminance.

As a result, the current-voltage characteristic of the light source part 320 varies according to the ambient temperature T when in a fixed current state. Although the LED current ILED has a constant level, when the ambient temperature T increases, the forward voltage VF of the light source part 320 decreases so that the luminance of the light source part 320 decreases. Although the LED current ILED has a constant level, when the ambient temperature T decreases, the forward voltage VF of the light source part 320 increases so that the luminance of the light source part 320 increases. Based on the above result, when the light source apparatus 300 is just turned on, the temperature of the light source part 320 is low so that the display apparatus represents a relatively high luminance. However, the turn-on duration of the light source apparatus 300 increases, the temperature of the light source part 320 gradually increases so that the luminance of the display apparatus gradually decreases.

Figure 7:
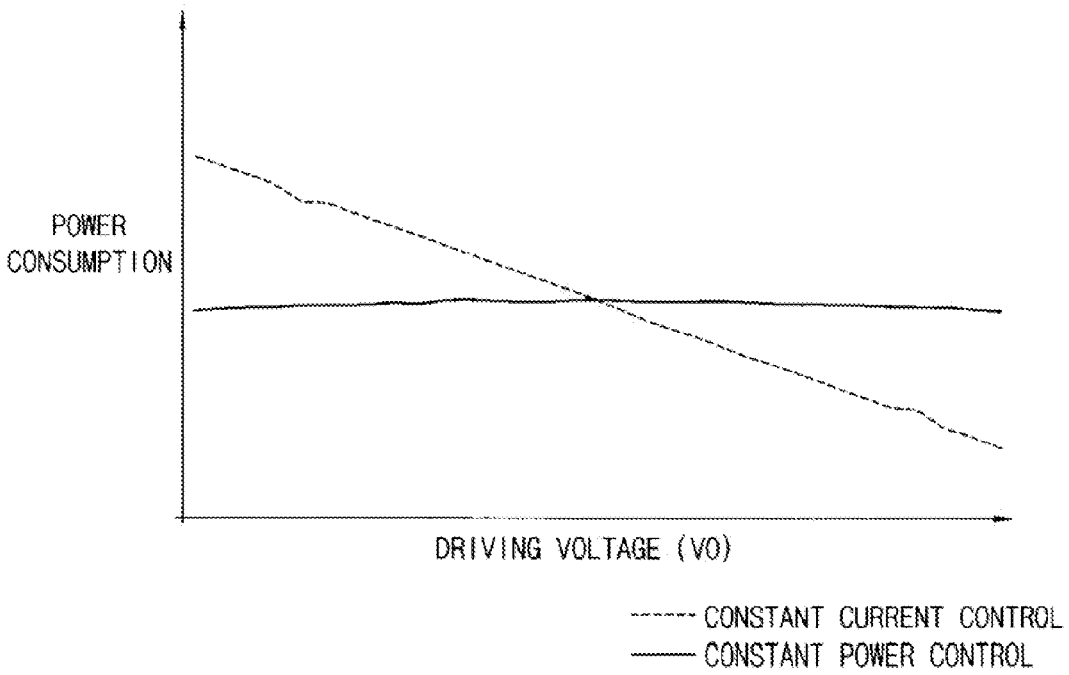
FIG. 7 is a graph illustrating a power consumption of the light source part of FIG. 2 according to a driving voltage and driving method.
Figure 8:
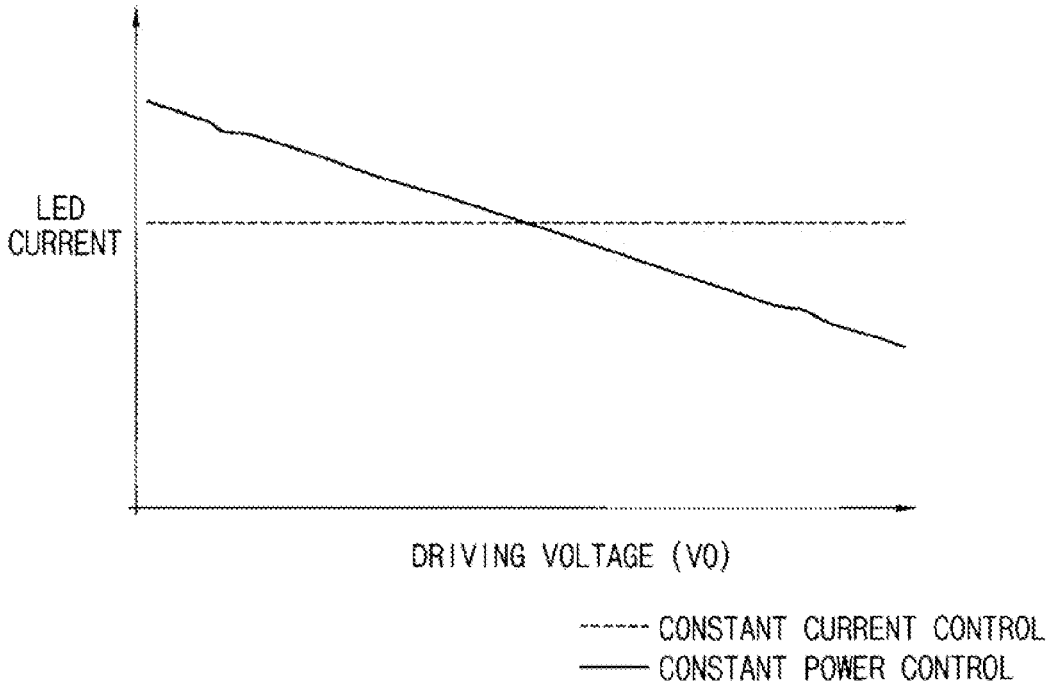
FIG. 8 is a graph illustrating an LED current of the light source part of FIG. 2 according to the driving voltage and driving method.

FIG. 7 is a graph illustrating a power consumption of the light source part 320 of FIG. 2 according to a variation of driving voltage. FIG. 8 is a graph illustrating the LED current ILED of the light source part 320 of FIG. 2 according to the driving voltage VO.

Referring to FIGS. 7 and 8, as the turn-on duration of a light source apparatus 300 increases, the driving voltage VO gradually decreases but the LED current ILED maintains a constant level in a conventional constant current control method. Thus, as the turn-on duration of a light source apparatus 300 increases, the power consumption (and relative light output) of the light source part 320 decreases. In other words, as the turn-on duration of a light source apparatus 300 increases, the luminance of the display apparatus undesirably decreases.

Referring to FIGS. 1, 3, 7 and 8, the feedback part 360 generates the feedback signal FS using the first voltage V1 which is a voltage control parameter and the second voltage V2 which is a current control parameter in the constant power control method according to the present exemplary embodiment.

For example, when the driving voltage VO of the light source part 320 increases due to a reason such as a decrease of the local temperature T, the first voltage V1 correspondingly increases and the third voltage V3 (which is a negative function of V1) decreases. As the third voltage V3 decreases, the LED current ILED is controlled to decrease. Thus VO goes up but ILED counter-compensates by going down as is shown in FIG. 8 and therefore power P remains substantially constant and luminance also remains substantially constant despite the change in temperature T.

For example, when the driving voltage VO of the light source part 320 decrease due to a reason such as an increase of the local temperature T, the first voltage V1 decreases and the third voltage V3 correspondingly increases. As the third voltage V3 increases, the LED current ILED is controlled to increase.

Therefore, as the turn-on duration of the light source part 300 increases, the driving voltage VO decreases but the LED current ILED increases. Thus, the power consumption of the light source part 320 may maintain a substantially constant level regardless of the turn-on duration of the light source apparatus 300 and/or the local temperature of the light source 320. In the same manner, the luminance of the display apparatus may maintain a substantially constant level regardless of the turn-on duration of the light source apparatus 300 and/or the local temperature of the light source 320.

According to the present exemplary embodiment, the feedback part 360 generates the feedback signal FS using the first voltage V1 which is a voltage control parameter and the second voltage V2 which is a current control parameter so that the power consumption of the light source part 320 and the luminance of the display apparatus may maintain substantially constant levels regardless of the ambient temperature or the turn-on duration of the light source apparatus 300.

Figure 9:
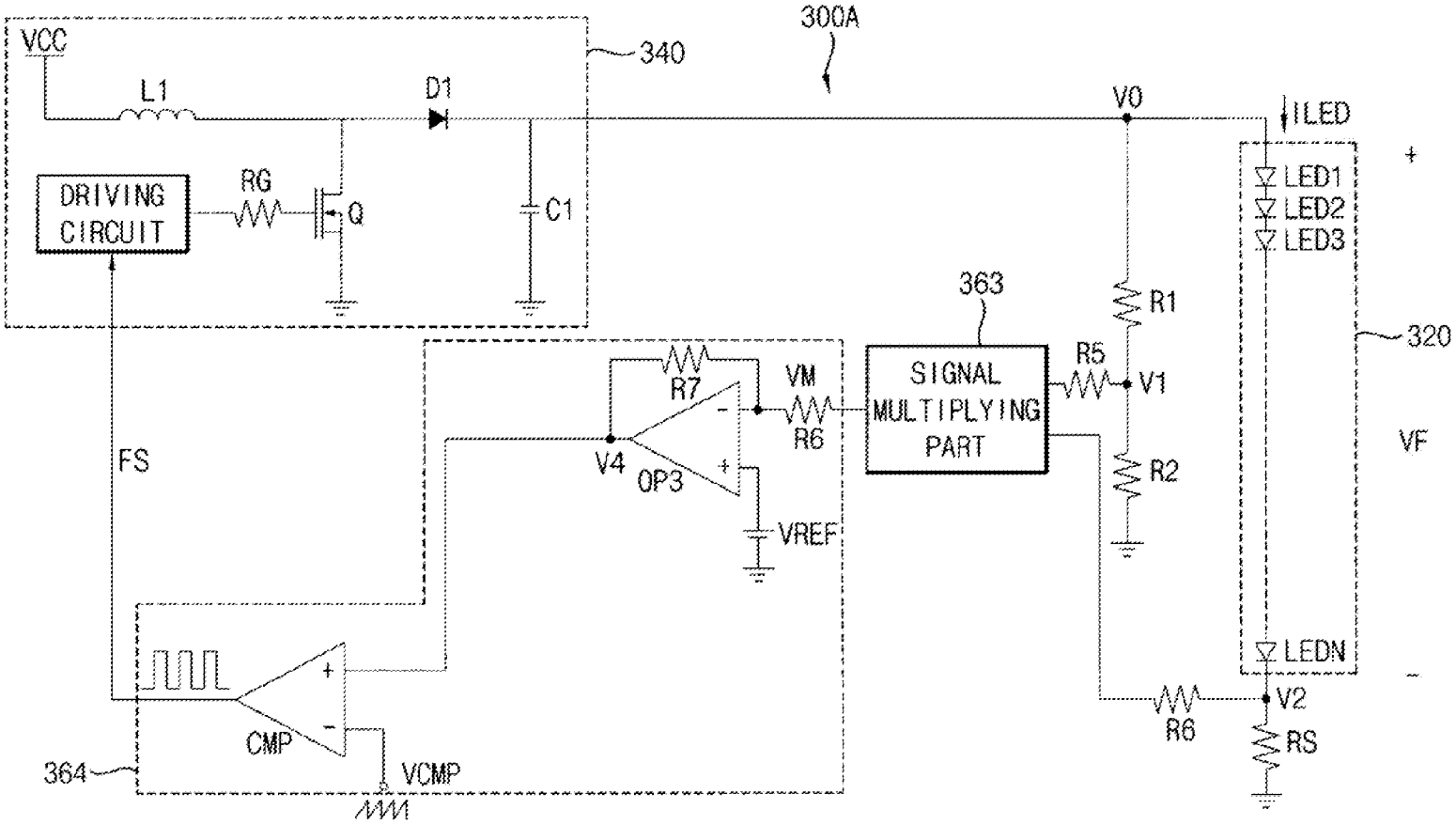
FIG. 9 is a circuit diagram illustrating a light source apparatus according to a second exemplary embodiment.

FIG. 9 is a circuit diagram illustrating a light source apparatus 300A according to an exemplary second embodiment in accordance with of the present disclosure of invention.

The light source apparatus 300A according to the present exemplary embodiment are substantially the same as the light source apparatus 300 explained referring to FIGS. 1 to 8 except for a structure of the feedback part 360 which includes a parameters multiplying part 363. Thus, the same reference numerals will be used to refer to the same or like parts as those described in FIGS. 1 to 8 and any repetitive explanation concerning the above elements will be omitted.

Referring to FIGS. 1, 2 and 9, a display apparatus includes a display panel 100, a light adjusting part 200 and a light source apparatus 300A.

The light source apparatus 300A includes a light source part 320, a voltage generating part 340 and a feedback part 360.

The light source part 320 emits a light. The light source part 320 provides the light to the display panel 100. The light source part 320 includes a plurality of LEDs connected to each other in series. The light source part 320 includes first to N-th LEDs LED1 to LEDN.

In the present exemplary embodiment, the light source part 320 may include a single LED string. The light source apparatus 300 may be an edge type light source apparatus. The light source part 320 may be disposed corresponding to a single side of the display panel 100.

The voltage generating part 340 generates a driving voltage VO to drive the light source part 320. For example, the voltage generating part 340 may be a DC (direct-current) to DC converter. Alternatively, the voltage generating part 340 may be a linear converter.

The feedback part 360 generates a feedback signal FS for adjusting the driving voltage VO. The feedback part 360 outputs the feedback signal FS to the voltage generating part 340.

The feedback part 360 generates the feedback signal FS using a first voltage V1, which is based on the driving voltage VO, outputted to a first end of the light source part 320, and a second voltage V2 sensed at a current sensor (e.g., RS) provided at a second end of the light source part 320.

The first voltage V1 is a voltage divided version of the driving voltage VO as established for example by the divider network comprised of first resistor R1 and second resistor R2. A first end of the first resistor R1 is connected to an output node of the voltage generating part 340. A second end of the first resistor R1 is connected to a first end of the second resistor R2. A second end of the second resistor R2 is connected to the ground. The first voltage V1 is a voltage sensed at a node between the first resistor R1 and the second resistor R2.

In the present exemplary embodiment, the feedback part 360 includes a signals multiplying part 363 and a feedback signal generating part 364. The feedback signal generating part 364 includes a third differential amplifier OP3 and a comparator CMP.

The signal multiplying part 363 receives the first voltage V1 and the second voltage V2. The signal multiplying part 363 generates a multiplied voltage VM representing a product of the magnitudes of the first voltage V1 and the second voltage V2. A fifth resistor R5 may be disposed at a first input node of the signal multiplying part 363 to which the first voltage V1 is applied. A sixth resistor R6 may be disposed at a second input node of the signal multiplying part 363 to which the second voltage V2 is applied. As in the previous embodiment, the first voltage V1 is a voltage control parameter of the light source part 320 and the second voltage V2 is a current control parameter of the light source part 320 so that the multiplied voltage VM represents a product of these parameters and thus may be a power control parameter of the light source part 320. Negative feedback Op Amp OP3 operates to minimize error between VM and the relatively constant VREF. Thus, the feedback part 360 may control the light source part 320 to be driven in a substantially constant power. Various possible structures and operations of the signal multiplying part 363 are explained in detail referring to FIGS. 10, 11 and 12.

As mentioned, in FIG. 9, the third differential amplifier OP3 receives the multiplied voltage VM and a reference voltage VREF. The third differential amplifier OP3 generates a fourth voltage V4 based on the multiplied voltage VM and the reference voltage VREF. The reference voltage VREF is applied to a non-inverting input node of the third differential amplifier OP3. The multiplied voltage VM is applied to an inverting input node of the third differential amplifier OP3. The fourth voltage V4 is outputted at an output node of the third differential amplifier OP3. The fourth voltage V4 is proportional to a difference between the reference voltage VREF and the multiplied voltage VM. A seventh resistor R7 may be disposed between the inverting input node of the third differential amplifier OP3 and an output node of the signal multiplying part 363. In addition, an eighth resistor R8 may be disposed between the inverting input node of the third differential amplifier OP3 and the output node of the third differential amplifier OP3.

The comparator CMP receives the fourth voltage V4 and a time-varying comparing signal VCMP (e.g., a sawtooth waveform or a triangular waveform). The comparator CMP compares the fourth voltage V4 to the comparing signal VCMP to output the digitized feedback signal FS. The fourth voltage V4 is applied to a non-inverting input node of the comparator CMP. The comparing signal VCMP is applied to an inverting input node of the comparator CMP. The feedback signal FS is outputted at an output node of the comparator CMP. The comparing signal VCMP may be a triangular wave signal. The feedback signal FS may be a square wave signal.

The feedback signal FS has a high level when the fourth voltage V4 is greater than the comparing signal VCMP. The feedback signal FS has a low level when the fourth voltage V4 is less than the comparing signal VCMP. As the fourth voltage V4 increases, a duty ratio of the feedback signal FS increases. As the fourth voltage V4 decreases, the duty ratio of the feedback signal FS decreases.

Figure 10:
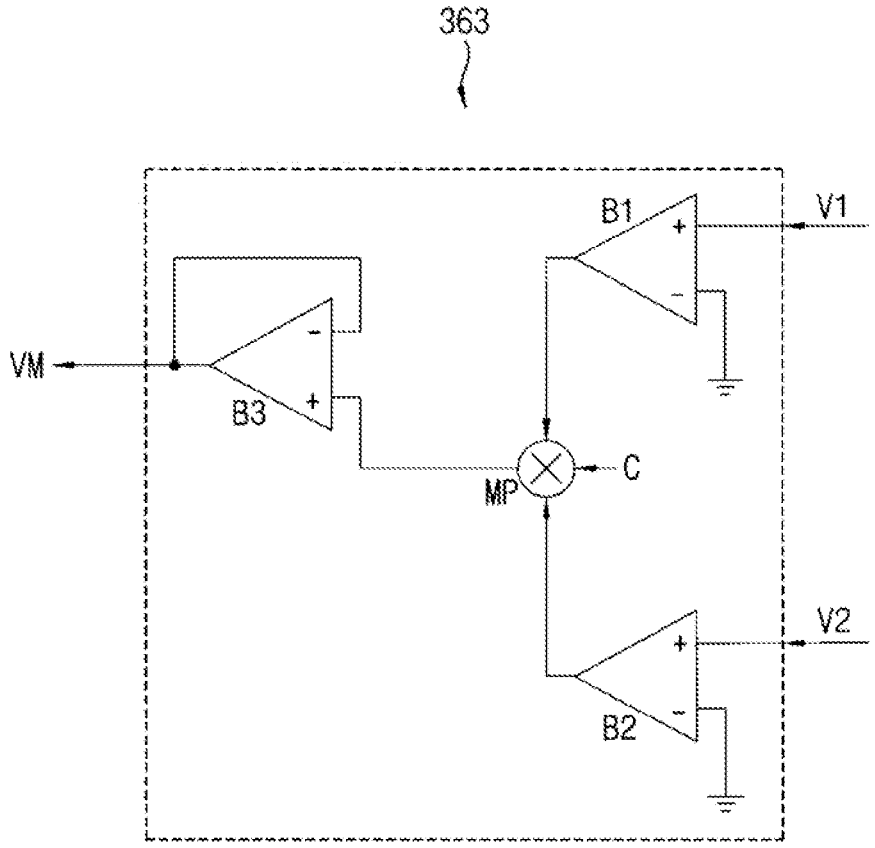
FIG. 10 is a circuit diagram illustrating a signal multiplying part of FIG. 9.

FIG. 10 is a circuit diagram illustrating one possible embodiment of the signal multiplying part 363 of FIG. 9.

Referring to FIGS. 9 and 10, the signal multiplying part 363 includes a first buffer B1, a second buffer B2, a third buffer B3 and an analog multiplier circuit MP.

The first voltage V1 is applied to the first buffer B1. The first voltage V1 is applied to a non-inverting input node of the first buffer B1. An inverting node of the first buffer B1 is connected to a ground. An output node of the first buffer B1 is connected to the multiplier MP.

The second voltage V2 is applied to the second buffer B2. The second voltage V2 is applied to a non-inverting input node of the second buffer B2. An inverting node of the second buffer B2 is connected to the ground. An output node of the second buffer B2 is connected to the multiplier MP.

The multiplier MP receives the first voltage V1 from the first buffer B1 and the second voltage V2 from the second buffer B2. The multiplier MP then multiplies the analog magnitudes of the first voltage V1 and the second voltage V2 to generate the multiplied voltage VM. The multiplier MP may multiply together not only the first voltage V1 and the second voltage V2 but also a multiplying constant C (where C could be 1 or another value) to generate the multiplied voltage VM. The multiplier MP outputs the multiplied voltage VM to the third buffer B3.

The third buffer B3 outputs the multiplied voltage VM to the third differential amplifier OP3. The multiplied voltage VM is applied to a non-inverting input node of the third buffer B3. An inverting input node of the third buffer B3 is connected to an output node of the third buffer B3.

Figure 11:
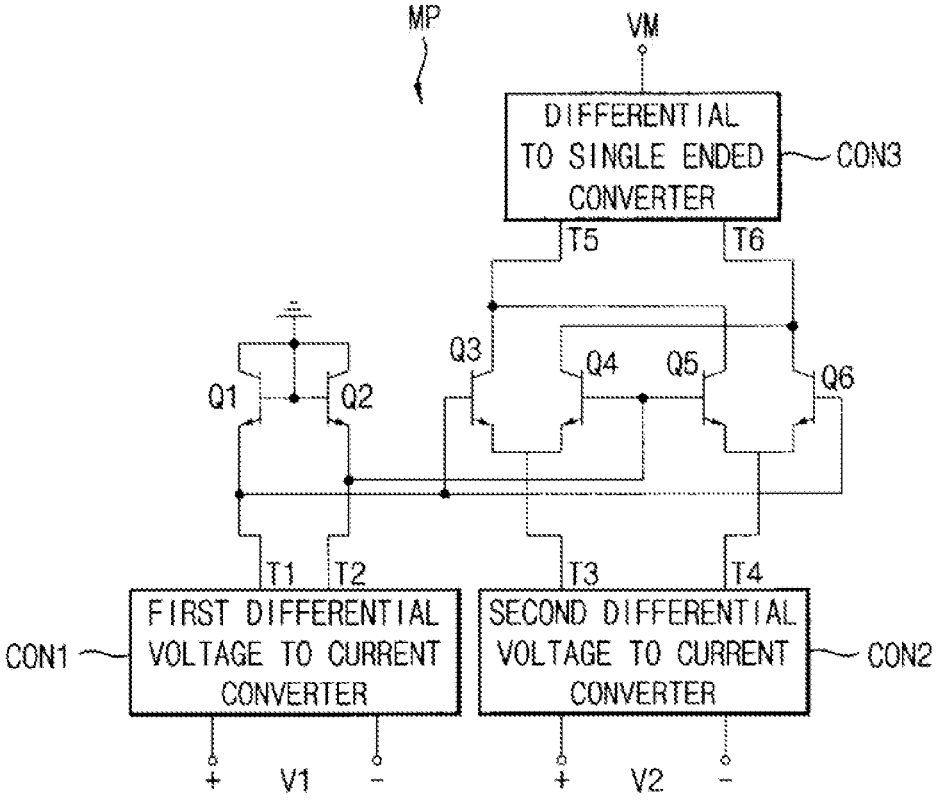
FIG. 11 is a circuit diagram illustrating a multiplier of FIG. 10.

FIG. 11 is a circuit diagram illustrating a possible embodiment of the analog multiplier circuit MP of FIG. 10.

Referring to FIG. 11, the multiplier MP includes a first differential voltage to current converter CON1 receiving the first voltage V1 as an input. The multiplier MP further includes a second differential voltage to current converter CON2 receiving the second voltage V2 as an input. The multiplier MP yet further includes a differential to single ended voltage converter CON3 outputting the multiplied voltage VM. Between the input and output converters CON1, CON2 and CON3 respectively, there are provided first and second bipolar transistors Q1 and Q2 which are connected to the first differential voltage to current converter CON1 and third, fourth, fifth and sixth transistors Q3, Q4, Q5 and Q6 which are connected to the second differential voltage to current converter CON2 and the differential to single ended converter CON3.

A base electrode and a collector electrode of the first bipolar transistor Q1 are connected to the ground. An emitter electrode of the first transistor Q1 is connected to a first terminal T1 of the first differential voltage to current converter CON1.

A base electrode and a collector electrode of the second transistor Q2 are connected to the ground. An emitter electrode of the second transistor Q2 is connected to a second terminal T2 of the first differential voltage to current converter CON1.

A base electrode of the third transistor Q3 is connected to the emitter electrode of the first transistor Q1. A collector electrode of the third transistor Q3 is connected to a first terminal T5 of the differential to single ended converter CON3. An emitter electrode of the third transistor Q3 is connected to a first terminal T3 of the second differential voltage to current converter CON2.

A base electrode of the fourth transistor Q4 is connected to the emitter electrode of the second transistor Q2. A collector electrode of the fourth transistor Q4 is connected to a second terminal T6 of the differential to single ended converter CON3. An emitter electrode of the fourth transistor Q4 is connected to the first terminal T3 of the second differential voltage to current converter CON2.

A base electrode of the fifth transistor Q5 is connected to the emitter electrode of the second transistor Q2. A collector electrode of the fifth transistor Q5 is connected to the first terminal T5 of the differential to single ended converter CON3. An emitter electrode of the fifth transistor Q5 is connected to a second terminal T4 of the second differential voltage to current converter CON2.

A base electrode of the sixth transistor Q6 is connected to the emitter electrode of the first transistor Q1. A collector electrode of the sixth transistor Q6 is connected to the second terminal T6 of the differential to single ended converter CON3. An emitter electrode of the sixth transistor Q6 is connected to the second terminal T4 of the second differential voltage to current converter CON2. The cross coupling of the emitter following outputs of Q1 and Q2 to the respective bases of Q3/Q6 and Q4/Q5 creates a condition where the input voltages V1 and V2 are effectively multiplied together. Although a specific bipolar transistor circuit is shown in FIG. 11, it is within the contemplation of the present disclosure that other analog multiplier circuits may be used.

According to the present exemplary embodiment, the feedback part 360 generates the feedback signal FS using the first voltage V1 which is a voltage control parameter and the second voltage V2 which is a current control parameter so that the power consumption of the light source part 320 and the luminance of the display apparatus may maintain substantially constant levels regardless of the local temperature and/or the turn-on duration of the light source apparatus 300A.

Figure 12:
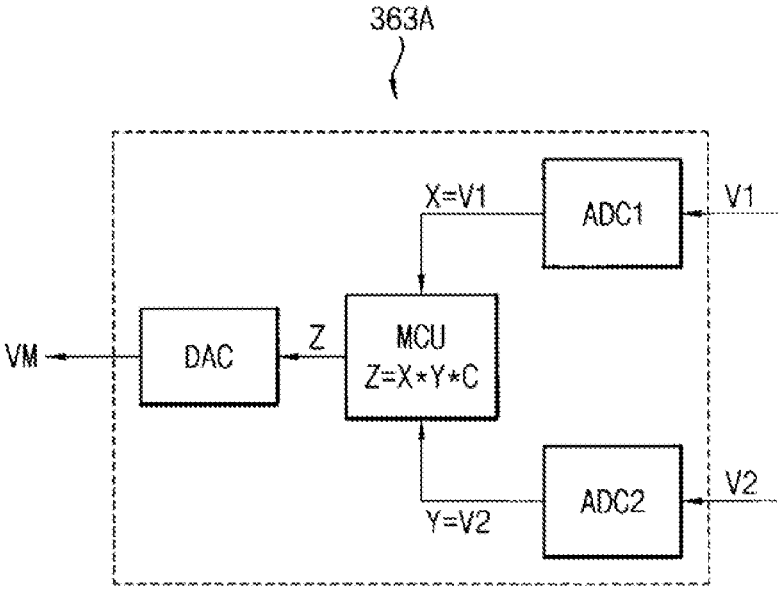
FIG. 12 is a circuit diagram illustrating a signal multiplying part of a light source apparatus according to another exemplary embodiment.

FIG. 12 is a circuit diagram illustrating an alternate signal multiplying part 363A of a light source apparatus according to an exemplary embodiment.

The light source apparatus 300A according to the present exemplary embodiment are substantially the same as the light source apparatus 300A explained referring to FIG. 9 except for a structure of the signal multiplying part 363A which includes a digital core portion and analog-to-digital or vise versa parts at its periphery. (Those skilled in the art will readily appreciate that the DAC is optional since all-digital processing may be used once the digitized product signal Z is developed. The DAC is shown for sake of consistency with the analog structure of FIG. 9.) The same reference numerals will be used for FIG. 12 to refer to the same or like parts as those described in FIG. 9 and any repetitive explanation concerning the above elements will be omitted.

Referring to FIGS. 9 and 12, the light source apparatus 300A includes a light source part 320, a voltage generating part 340 and a feedback part 360.

The feedback part 360 generates a feedback signal FS for adjusting the driving voltage VO. The feedback part 360 outputs the feedback signal FS to the voltage generating part 340.

The feedback part 360 generates the feedback signal FS using a first voltage V1, which is based on the driving voltage VO, outputted to a first end of the light source part 320, and a second voltage V2 sensed at a second end of the light source part 320.

The first voltage V1 is a divided voltage of the driving voltage VO by a first resistor R1 and a second resistor R2. A first end of the first resistor R1 is connected to an output node of the voltage generating part 340. A second end of the first resistor R1 is connected to a first end of the second resistor R2. A second end of the second resistor R2 is connected to the ground. The first voltage V1 is a voltage sensed at a node between the first resistor R1 and the second resistor R2.

In the present exemplary embodiment, the feedback part 360 includes a signal multiplying part 363A and a feedback signal generating part 364. The feedback signal generating part 364 includes a third differential amplifier OP3 and a comparator CMP.

The signal multiplying part 363A receives the first voltage V1 and the second voltage V2. The signal multiplying part 363A generates a multiplied voltage VM based on the first voltage V1 and the second voltage V2. The first voltage V1 is a voltage control parameter of the light source part 320 and the second voltage V2 is a current control parameter of the light source part 320 so that the multiplied voltage VM may be a power control parameter of the light source part 320. Thus, the feedback part 360 may control the light source part 320 to be driven in a substantially constant power.

The signal multiplying part 363A of FIG. 12 includes a first analog to digital converter ADC1, a second analog to digital converter ADC2, a micro control unit MCU (e.g., could be a microprocessor or equivalent) and a digital to analog converter DAC.

The first analog to digital converter ADC1 receives the analog first voltage V1 and converts the first voltage V1 to a corresponding digital type signal. The first analog to digital converter ADC1 outputs the first voltage V1 having the digital type to the micro control unit MCU.

The second analog to digital converter ADC2 receives the analog second voltage V2 and converts the second voltage V2 to a corresponding digital type signal. The second analog to digital converter ADC2 outputs the second voltage V2 having the digital type to the micro control unit MCU.

The micro control unit MCU receives the first voltage V1 having the digital type and the second voltage V2 having the digital type. The micro control unit MCU internally multiplies the first voltage V1 having the digital type and the second voltage V2 having the digital type together with a supplied digital equivalent of the constant C value (could be 1) to thereby generate the product signal, Z. The DAC converts the product signal, Z into analog form thus generating the multiplied voltage VM having the analog type. The digital to analog converter DAC outputs the multiplied voltage VM having the analog type to the third differential amplifier OP3.

The third differential amplifier OP3 (in FIG. 9) receives the multiplied voltage VM and a reference voltage VREF. The third differential amplifier OP3 generates a fourth voltage V4 based on the multiplied voltage VM and the reference voltage VREF.

The comparator CMP receives the fourth voltage V4 and a comparing signal VCMP. The comparator CMP compares the fourth voltage V4 to the comparing signal VCMP to output the feedback signal FS.

According to the present exemplary embodiment, the feedback part 360 therefore generates the feedback signal FS using the first voltage V1 which is a voltage control parameter and the second voltage V2 which is a current control parameter so that the power consumption of the light source part 320 and the luminance of the display apparatus may maintain substantially constant levels regardless of the ambient temperature or the turn-on duration of the light source apparatus 300A. As mentioned above, back conversion from digital to analog by the DAC and then production of the digitized FS feedback signal is not necessary. Instead the MCU can be programmed to directly produce the digitized FS feedback signal. The embodiment of FIG. 12 is merely an illustrative example.

Figure 13:
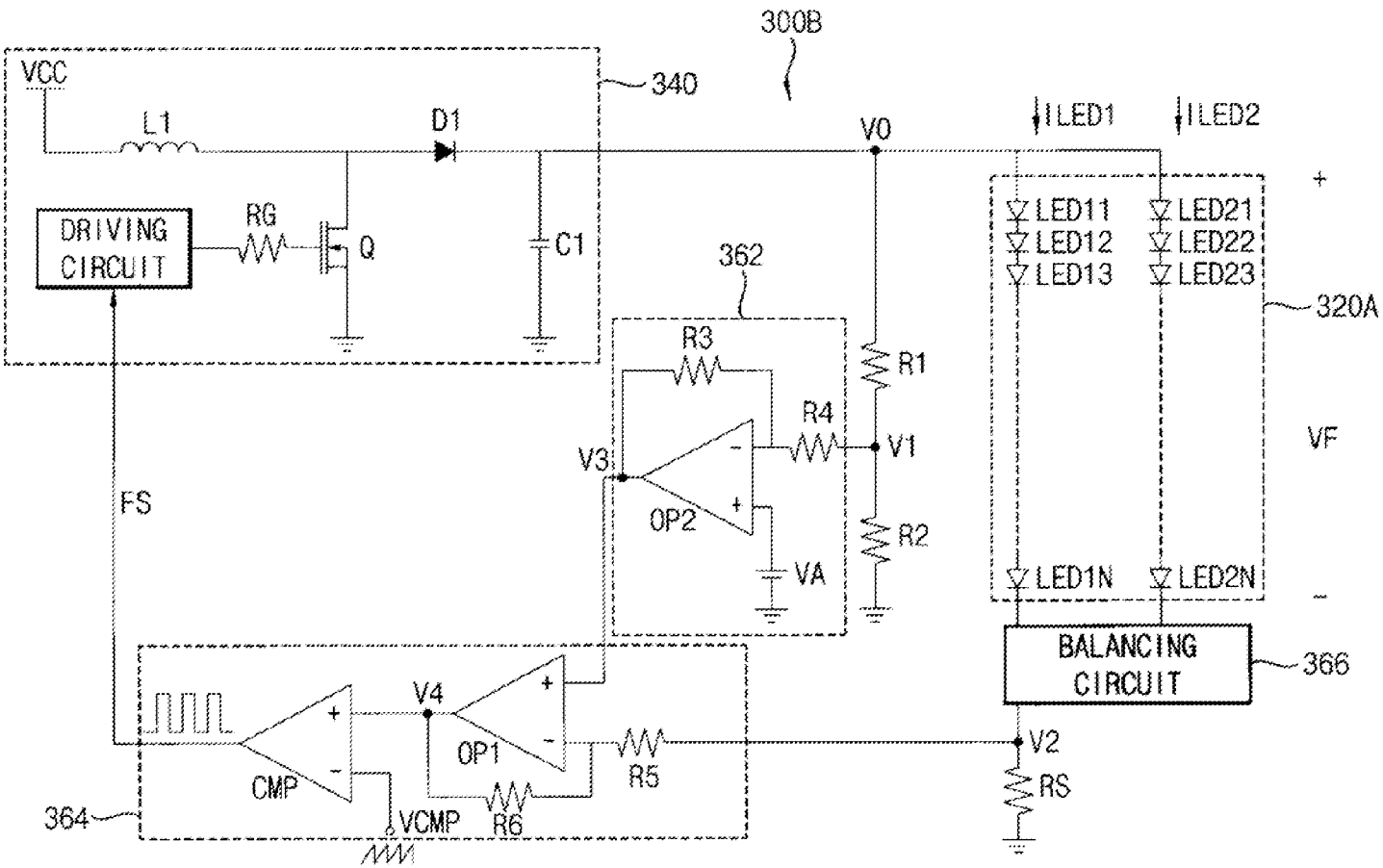
FIG. 13 is a circuit diagram illustrating a light source apparatus according to an third exemplary embodiment.

FIG. 13 is a circuit diagram illustrating a light source apparatus 300B according to an exemplary third embodiment of the present disclosure of invention.

The light source apparatus 300B according to the present exemplary embodiment are substantially the same as the light source apparatus 300 explained referring to FIGS. 1 to 8 except for a structure of the light source part 320A which is shown to include a plurality of LED strings coupled to a currents balancing part 366. Thus, the same reference numerals will be used to refer to the same or like parts as those described in FIGS. 1 to 8 and any repetitive explanation concerning the above elements will be omitted.

Referring to FIGS. 1, 2 and 13, the light source apparatus 300B includes a light source part 320A, a voltage generating part 340 and a feedback part 360.

The light source part 320A emits a light. The light source part 320A provides the light to the display panel 100. The light source part 320A includes a plurality of LED strings connected to each other substantially in parallel so that they both develop substantially the same forward drop voltage VF. Each of the LED strings includes a plurality of LEDs connected to each other in series. The light source part 320A includes a first light emitting diode string LED11 to LED1N and a second light emitting diode string LED21 to LED2N.

The light source apparatus 300B may be an edge type light source apparatus. The light source part 320A may be disposed corresponding to a single side of the display panel 100. For example, the light source part 320A may be disposed corresponding to a shorter side of the display panel 100. Alternatively, the light source part 320A may be disposed corresponding to a longer side of the display panel 100.

Alternatively, the light source part 320A may be disposed corresponding to both sides of the display panel 100. Alternatively, the light source part 320A may be disposed corresponding to shorter sides of the display panel 100 facing each other. Alternatively, the light source part 320A may be disposed corresponding to longer sides of the display panel 100 facing each other.

Alternatively, the light source part 320A may be disposed corresponding to all sides of the display panel 100. Alternatively, the light source part 320A may be disposed corresponding to a corner portion of the display panel 100.

The light source apparatus 300B may further include a light guide plate guiding the light generated from the light source part 320A to the display panel 100. The light guide plate may include a rectangular parallelepiped shape. The light guide plate may include a wedge shape in a cross-sectional view.

Alternatively, the light source apparatus 300B may be a direct type light source apparatus. The light source part 320A may be disposed corresponding to an entire portion of the display panel 100.

First ends of the light emitting diode strings are connected to an output node of the voltage generating part 340. The light source apparatus 300B further includes a balancing circuit 366 connected to second ends of the light emitting diode strings. The balancing circuit 366 adjusts a first LED current ILED1 flowing through the first light emitting diode string and a second LED current ILED2 flowing through the second light emitting diode string such that the first LED current ILED1 and the second LED current ILED2 have substantially the same level as each other (or alternatively are otherwise proportional to one another according to a predetermined proportionality value). The LEDs of the first and second strings may be of same kind (e.g., same color ones) or they may be different kinds of LEDs (e.g., differently colored ones) or they may be different kinds of light sources (e.g., a mixture of organic LEDs (a.k.a. OLEDs) and semiconductor LEDs). The balancing circuit 366 outputs to sensing resistor RS, a current that is proportional to the currents in the balanced LED strings.

Although the light source part 320A includes two LED strings in FIG. 13, the number of the LED strings is not limited thereto and may be larger.

The voltage generating part 340 generates a driving voltage VO to drive the light source part 320A. For example, the voltage generating part 340 may be a DC to DC converter.

The feedback part 360 generates a feedback signal FS for adjusting the driving voltage VO. The feedback part 360 outputs the feedback signal FS to the voltage generating part 340.

The feedback part 360 generates the feedback signal FS using a first voltage V1, which is based on the driving voltage VO outputted to the first ends of the light source part 320A, and a second voltage V2 sensed at the second ends of the light source part 320A.

In the present exemplary embodiment, the feedback part 360 includes a reference voltage compensating circuit 362 and a feedback signal generating part 364. The feedback signal generating part 364 includes a first differential amplifier OP1 and a comparator CMP.

According to the present exemplary embodiment, the feedback part 360 generates the feedback signal FS using the first voltage V1 which is a voltage control parameter and the second voltage V2 which is a current control parameter so that the power consumption of the light source part 320A and the luminance of the display apparatus may maintain substantially constant levels regardless of the local temperature and/or the turn-on duration of the light source apparatus 300B.

Figure 14:
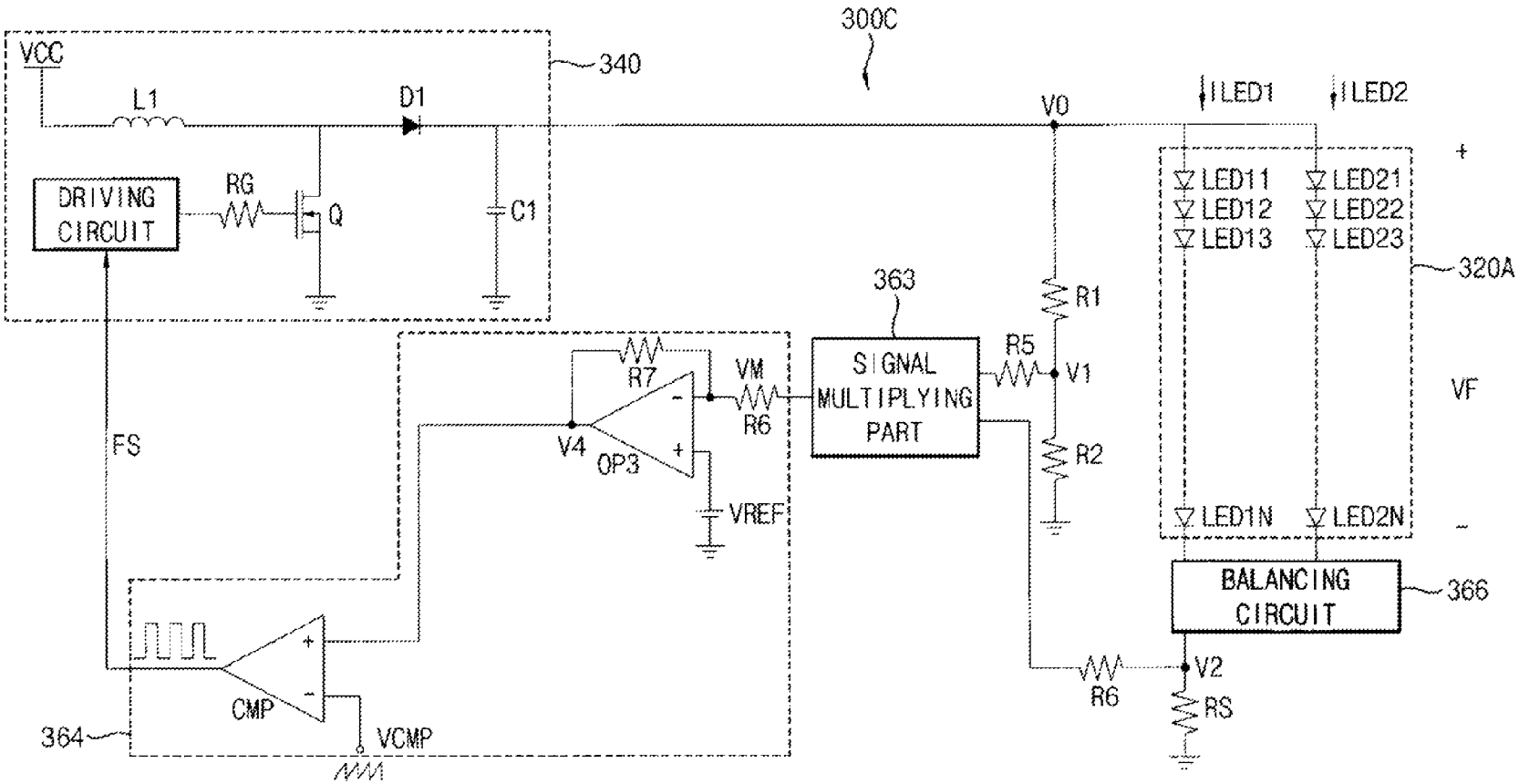
FIG. 14 is a circuit diagram illustrating a light source apparatus according to another exemplary embodiment.

FIG. 14 is a circuit diagram illustrating a light source apparatus according to a fourth exemplary embodiment of the present disclosure.

The light source apparatus 300C according to the present exemplary embodiment are substantially the same as the light source apparatus 300A explained referring to FIG. 9 except for a structure of the light source part 320A. Thus, the same reference numerals will be used to refer to the same or like parts as those described in FIG. 9 and any repetitive explanation concerning the above elements will be omitted.

Referring to FIGS. 1, 2 and 14, the light source apparatus 300C includes a light source part 320A, a voltage generating part 340 and a feedback part 360.

The light source part 320A emits a light. The light source part 320A provides the light to the display panel 100. The light source part 320A includes a plurality of LED strings connected to each other in parallel. Each of the LED strings includes a plurality of LEDs connected to each other in series. The light source part 320A includes a first light emitting diode string LED11 to LED1N and a second light emitting diode string LED21 to LED2N.

The light source apparatus 300C may be an edge type light source apparatus. The light source part 320A may be disposed corresponding to a single side of the display panel 100. Alternatively, the light source part 320A may be disposed corresponding to both sides of the display panel 100. Alternatively, the light source part 320A may be disposed corresponding to all sides of the display panel 100. Alternatively, the light source part 320A may be disposed corresponding to a corner portion of the display panel 100.

The light source apparatus 300C may further include a light guide plate guiding the light generated from the light source part 320A to the display panel 100. The light guide plate may include a rectangular parallelepiped shape. The light guide plate may include a wedge shape in a cross-sectional view.

Alternatively, the light source apparatus 300C may be a direct type light source apparatus. The light source part 320A may be disposed corresponding to an entire portion of the display panel 100.

First ends of the light emitting diode strings are connected to an output node of the voltage generating part 340. The light source apparatus 300C further includes a balancing circuit 366 connected to second ends of the light emitting diode strings. The balancing circuit 366 adjusts a first LED current ILED1 flowing through the first light emitting diode string and a second LED current ILED2 flowing through the second light emitting diode string such that, for example, the first LED current ILED1 and the second LED current ILED2 have substantially the same level as each other.

Although the light source part 320A includes two LED strings in FIG. 14, the number of the LED strings is not limited thereto and may be larger.

The voltage generating part 340 generates a driving voltage VO to drive the light source part 320A. For example, the voltage generating part 340 may be a DC to DC converter.

The feedback part 360 generates a feedback signal FS for adjusting the driving voltage VO. The feedback part 360 outputs the feedback signal FS to the voltage generating part 340.

The feedback part 360 generates the feedback signal FS using a first voltage V1, which is based on the driving voltage VO outputted to the first ends of the light source part 320A, and a second voltage V2 sensed at the second ends of the light source part 320A.

In the present exemplary embodiment, the feedback part 360 includes a signal multiplying part 363 and a feedback signal generating part 364. The feedback signal generating part 364 includes a third differential amplifier OP3 and a comparator CMP.

According to the present exemplary embodiment, the feedback part 360 generates the feedback signal FS using the first voltage V1 which is a voltage control parameter and the second voltage V2 which is a current control parameter so that the power consumption of the light source part 320A and the luminance of the display apparatus may maintain substantially constant levels regardless of the local temperature and/or the turn-on duration of the light source apparatus 300C.

According to the present disclosure of invention as explained above, the feedback part drives the light source part in a substantially constant power mode by using a voltage control parameter and a current control parameter and/or a power control parameter of the light source part so that the power consumption and the luminance of the light source part may maintain substantially constant levels. Thus, the display quality of the display apparatus may be improved.

The foregoing is illustrative of the present disclosure of invention and is not to be construed as limiting thereof. Although a few example embodiments have been described, those skilled in the art will readily appreciate in light of the foregoing that many modifications are possible in the example embodiments without materially departing from the novel teachings and advantages of the present disclosure. Accordingly, all such modifications are intended to be included within the scope of the present teachings. In the claims, means-plus-function clauses are intended to cover the structures described herein as performing the recited function and not only structural equivalents but also functionally equivalent structures.

What is claimed is:

1. A method of driving a light source, the method comprising:

outputting a variable driving voltage to a light source part;

sensing a first voltage based on the driving voltage at a first end of the light source part;

sensing a second voltage at a second end of the light source part;

and adjusting the variable driving voltage using the first and second voltages, wherein the first voltage is a linear function of the variable driving voltage, and wherein the adjusting of the driving voltage comprises:

generating a third voltage based on the first voltage and a supplied first reference voltage:

generating a fourth voltage based on the second voltage and the third voltage:

comparing the fourth voltage to a time-varying comparing signal; and outputting a digital feedback signal based on the comparing of the fourth voltage with the time-varying comparing signal.

2. The method of claim 1, wherein the light source part includes a plurality of light emitting diodes connected to each other in series.

3. The method of claim 1, wherein the light source part includes a plurality of light emitting diode strings connected to each other in parallel, and each of the light emitting diode strings includes a plurality of light emitting diodes connected to each other in series.

4. A light source apparatus comprising:

a light source part configured for emitting a light;

a voltage generating part configured for generating a variable driving voltage to drive the light source part; and a feedback part configured for adjusting the driving voltage using a first voltage outputted to a first end of the light source part and a second voltage sensed at a second end of the light source part, the first voltage being based on the driving voltage and the second voltage being based on a current passing through the light source part, wherein the first voltage is a divided voltage of the driving voltage as divided by a first resistor and a second resistor, and wherein the feedback part comprises:

a reference voltage compensating circuit configured for generating a third voltage based on the first voltage and a supplied first reference voltage;

a first differential amplifier configured for generating a fourth voltage based on the second voltage and the third voltage; and a comparator configured for comparing the fourth voltage to a supplied second reference voltage and for outputting a corresponding feedback signal.

5. The light source apparatus of claim 4, wherein the light source part includes a plurality of light emitting diodes connected to each other in series.

6. The light source apparatus of claim 4, wherein the light source part includes a plurality of light emitting diode strings connected to each other in parallel, and each of the light emitting diode strings includes a plurality of light emitting diodes connected to each other in series.

7. The light source apparatus of claim 4, wherein the voltage generating part includes a driving circuit, an inductor, a diode, a capacitor and a switching element, the driving circuit receives a feedback signal from the feedback part and is operatively coupled to a gate of the switching element, a drain portion of the switching element is connected to the inductor and to the diode, a power source voltage is applied to a first end of the inductor, a cathode electrode of the diode is connected to a first end of the capacitor, and a second end of the capacitor is coupled to ground.

8. The light source apparatus of claim 4, wherein the reference voltage compensating circuit includes a second differential amplifier, a third resistor and a fourth resistor, and the first reference voltage is applied to a non-inverting input node of the second differential amplifier, an inverting input node of the second differential amplifier is connected to a first end of the third resistor and a first end of the fourth resistor, an output node of the second differential amplifier is connected to a second end of the third resistor, and the first voltage is applied to a second end of the fourth resistor.

9. A light source apparatus comprising:

a light source part configured for emitting a light;

a voltage generating part configured for generating a variable driving voltage to drive the light source part; and a feedback part configured for adjusting the driving voltage using a first voltage outputted to a first end of the light source part and a second voltage sensed at a second end of the light source part, the first voltage being based on the driving voltage and the second voltage being based on a current passing through the light source part, wherein the first voltage is a divided voltage of the driving voltage as divided by a first resistor and a second resistor, and wherein the feedback part comprises:

a signal multiplying part configured for generating a multiplied voltage by multiplying the first voltage and the second voltage;

a differential amplifier configured for generating a fourth voltage based on the multiplied voltage and a supplied reference voltage; and a comparator configured for comparing the fourth voltage to a supplied time-varying comparing signal and to output a digitized feedback signal based on the comparison.

10. The light source apparatus of claim 9, wherein the signal multiplying part comprises a first buffer, a second buffer, a third buffer and a multiplier, the first voltage is connected so as to be applied to the first buffer, the second voltage is connected so as to be applied to the second buffer, the multiplier is connected so as to multiply the first voltage and the second voltage to thereby generate the multiplied voltage and to output the multiplied voltage to the third buffer.

11. The light source apparatus of claim 10, wherein the multiplier comprises:

a first differential voltage to current converter coupled for receiving the first voltage;

a second differential voltage to current converter coupled for receiving the second voltage;

a differential to single ended converter configured for outputting the multiplied voltage;

first and second transistors which are connected to the first differential voltage to current converter; and third, fourth, fifth and sixth transistors which are connected to the second differential voltage to current converter and the differential to single ended converter.

12. The light source apparatus of claim 9, wherein the signal multiplying part comprises:

a first analog to digital converter configured for receiving the first voltage and for converting the first voltage to a digital type;

a second analog to digital converter configured for receiving the second voltage and for converting the second voltage to a digital type; and a digital data processing unit configured for generating a multiplied voltage by multiplying the first voltage having the digital type and the second voltage having the digital type.

13. A display apparatus comprising:

a display panel configured for displaying an image; and a light source apparatus configured for providing a light to the display panel, the light source apparatus including:

a light source part configured for emitting the light;

a voltage generating part configured for generating a variable driving voltage to drive the light source part; and a feedback part configured for adjusting the driving voltage using a first voltage sensed at a first end of the light source part and a second voltage sensed at an opposed second end of the light source part, the first voltage being based on the driving voltage and the second voltage being based on a current passing through the light source part, wherein the first voltage is a divided voltage of the driving voltage as divided by a first resistor and a second resistor, and wherein the feedback part comprises:

a reference voltage compensating circuit configured for generating a third voltage based on the first voltage and a supplied first reference voltage;

a first differential amplifier configured for generating a fourth voltage based on the second voltage and the third voltage: and a comparator configured for comparing the fourth voltage to a supplied second reference voltage and for outputting a corresponding feedback signal.

14. A method of driving a light source, the method comprising:

outputting a variable driving voltage to a light source part;

sensing a first voltage that is substantially representative of a voltage drop developed across the light source part;

sensing a second voltage that is substantially representative of a current passing through the light source part;

developing a feedback controlling signal from the first and second sensed voltages that is substantially representative of a power consumption of the light source part; and adjusting the variable driving voltage based on the developed feedback controlling signal, wherein the first voltage is a linear function of the variable driving voltage, and wherein the developing the feedback controlling signal comprises:

generating a third voltage based on the first voltage and a supplied first reference voltage;

generating a fourth voltage based on the second voltage and the third voltage;

comparing the fourth voltage to a time-varying comparing signal; and comparing the fourth voltage with the time-varying comparing signal.

* * * * *